US005431303A

United States Patent [19]

Miskell

[11] Patent Number: 5,431,303

[45] Date of Patent: Jul. 11, 1995

[54] TWO-PART AEROSOL DISPENSER EMPLOYING FUSIBLE PLUG

[76] Inventor: David L. Miskell, 14571 Baumhart Rd., Oberlin, Ohio 44074-9618

[21] Appl. No.: 129,751

[22] Filed: Sep. 30, 1993

[51] Int. Cl.[6] ..... B67D 5/08

[52] U.S. Cl. ..... 222/54; 222/145.1

[58] Field of Search ..... 222/54, 135, 145, 146.3; 206/221; 137/74, 76

[56] References Cited

U.S. PATENT DOCUMENTS

| | | | |
|---|---|---|---|
| 2,759,768 | 8/1956 | Sato | 222/54 |
| 3,181,737 | 5/1965 | Chaucer | 222/136 |
| 3,314,571 | 4/1967 | Greenebaum | 222/135 |
| 3,343,718 | 9/1967 | Siegel et al. | 222/1 |
| 3,443,726 | 5/1969 | Muller et al. | 222/145 |
| 3,556,171 | 1/1971 | Gangwisch et al. | 141/3 |
| 3,698,453 | 10/1972 | Morane et al. | 141/349 |
| 3,817,297 | 6/1974 | King | 141/20 |
| 4,988,017 | 1/1991 | Schrader et al. | 222/130 |
| 4,995,533 | 2/1991 | Vandoninck | 222/54 |

*Primary Examiner*—Andres Kashnikow
*Assistant Examiner*—Philippe Derakshani
*Attorney, Agent, or Firm*—Rankin, Hill, Lewis & Clark

[57] ABSTRACT

Two-part reactive polymeric paints are prepared and applied from an integral dispensing system. The reactive components are held in two separate containers and are maintained separate from one another by a fusible plug. To use the dispenser, heat is applied to the fusible plug to melt the plug and permit the container contents to mix together. Differential pressure between the containers causes the components to mix and begin to react; a net positive pressure with respect to the ambient atmosphere permits the mixed components to be applied as a spray. In an alternative embodiment, a flexible, external spray feed tube permits easier paint application than by conventional paint spray cans.

13 Claims, 2 Drawing Sheets

TWO-PART AEROSOL DISPENSER EMPLOYING FUSIBLE PLUG

BACKGROUND OF THE INVENTION

1. Field of the Invention

The invention relates to spray cans for dispensing products such as paint and, more particularly, to a dispenser in which pressurized reactive components stored in individual cans are kept separate until needed by means of a fusible plug which may be melted readily to permit the components to be mixed for use.

2. Description of the Prior Art

Automotive paint spraying systems for small-scale restoration of the finish of older vehicles or to repair nicks and scratches have been known for many years. The familiar spray paint can is simply a rolled metal can filled with pressurized propellant and a previously cured thermoset paint or coating which has been pulverized into very small particulates and suspended in a solvent. After being sprayed onto the part surface, the solvent is allowed to evaporate, leaving a dry, hard paint layer.

While this is a convenient and inexpensive application method, the paint layer being applied does not approach the level of durability and protection of which the thermoset coating material is capable. This is because the thermoset particulates that make up the paint layer are only softened by the solvent and not actually dissolved. The resulting paint layer is thus made up of tiny overlapping paint chips. While they are stuck together sufficiently to give an apparently uniform surface, the surface is in fact discontinuous at a microscopic scale. The surface thus lacks integrity at the microscopic scale, limiting durability, and the residual porosity permits environmental agents to penetrate to the substrate.

To achieve a continuous thermoset paint surface, such as that applied by original equipment manufacturers, chemically reactive components must be applied so as to cure seamlessly on the part surface itself. Such familiar paints as epoxies, polyurethanes, and polyacrylamides generally require mixing a pigmented reactive constituent with a catalyst or curing agent which initiates the thermosetting reaction. The reacting mixture is then sprayed under pressure from a compressor onto the surface to be painted, where both chemical reaction and solvent evaporation take place.

While the paint layer so applied demonstrates superior durability and imparts improved weather and corrosion resistance to the substrate, this application mode has several limitations. Because the reaction takes place quickly, and generally runs to completion once begun, application of reactive systems often involves fairly rigorous storage precautions, careful application preparation, and solvent-intensive clean-up procedures. Moreover, the chemical reactants themselves often may only be purchased in bulk, at least relative to the amount of palm needed to repair the usual scratches and nicks a home do-it-yourselfer would be repainting. In addition, such multi-constituent paint application also requires mixing componentry such as a spray gun and a compressor, with their attendant cost of rental or purchase.

Several attempts have been made to match the convenience of a small spray can dispenser with the durability and protection of a reactive system. These systems generally involve linking separate, differentially pressurized canisters containing the reactive species by means of valves which permit the constituents to be mixed together just prior to application. Such an arrangement permits better coatings to be applied from more convenient, disposable dispensers.

Such systems include those described in U.S. Pat. No. 3,181,737 to Chaucer, U.S. Pat. No. 3,343,718 to Siegel et al., U.S. Pat. No. 3,698,453 to Morane et al., and U.S. Pat. No. 4,988,017 to Schrader et al. In these devices, a vessel containing fluid under higher pressure is coupled through one or more mechanically operated valves to a vessel under lower pressure. These mechanical valves generally include many components, some of which require close tolerances and detailed machining. Upon activating the valves, the higher pressure fluid is transferred into the lower pressure container, from which the mixture of the two fluids can be sprayed.

While these two-canister systems offer superior coating potential, they have relatively complicated coupling valves, which add unnecessary cost to the system. Somewhat simpler valves are disclosed in U.S. Pat. No. 3,556,171 to Gangwisch et al., U.S. Pat. No. 3,314,571 to Greenebaum, and U.S. Pat. No. 3,817,297 to King, each of which discloses a re-tillable aerosol system. These latter systems, however, do not provide for the mixing of multiple constituents. Instead, they are intended to provide storage quantities of perfume, for example, that can be used to replenish smaller dispenser canisters.

Desirably, an aerosol paint dispenser for home or shop use by the do-it-yourselfer should be compact to reflect the generally limited amount of paint needed for the ordinary use to which it is put. The dispenser also should allow the application of reactive constituents to provide a coating which is physically and chemically superior to those of common spray paints. Further, the dispenser should provide means of assuring that the constituents are kept separate from each other until needed for use. The dispenser package also should be sufficiently inexpensive and simple to use so that it will be purchased and used by as many consumers as possible.

SUMMARY OF THE INVENTION

In response to the foregoing concerns, the present invention provides a new and improved two-part aerosol dispenser especially adapted to dispense polymerizable paint. The dispenser according to the present invention includes two canisters separately containing reactive constituents, the canisters being joined by a passageway. A fusible plug is disposed in the passageway to present a physical block to mixing the contents of the two canisters. The block is readily overcome through the deliberate application of moderate amounts of heat.

When the fusible plug between the canisters is melted by applying heat, the contents of the first container are forced into the second container where they begin to react. The melting temperature of the fusible plug is sufficiently high to prevent loss of sealing capacity during ordinary transportation and storage. The melting temperature is sufficiently low, however, to avoid problems related to overheating the pressurized chemical reactants. The optimum melting temperature range for the fusible plugs is about 135°–185° F. Accordingly, polyethylene waxes, gallium alloys and other low temperature metal alloys are suitable for use as fusible plugs.

The dispenser according to the present invention is exceedingly inexpensive and easy to manufacture relative to other two-component aerosol dispensers. It is simple to operate, permitting the preparation of highly durable and chemically resistant coatings merely by placing the passageway under hot tap water or by heating the passageway with a hair dryer.

The foregoing and other features and advantages of the present invention are illustrated in the accompanying drawings and are described in more detail in the specification and claims that follow.

DESCRIPTION OF THE PREFERRED EMBODIMENT

Figure 1:
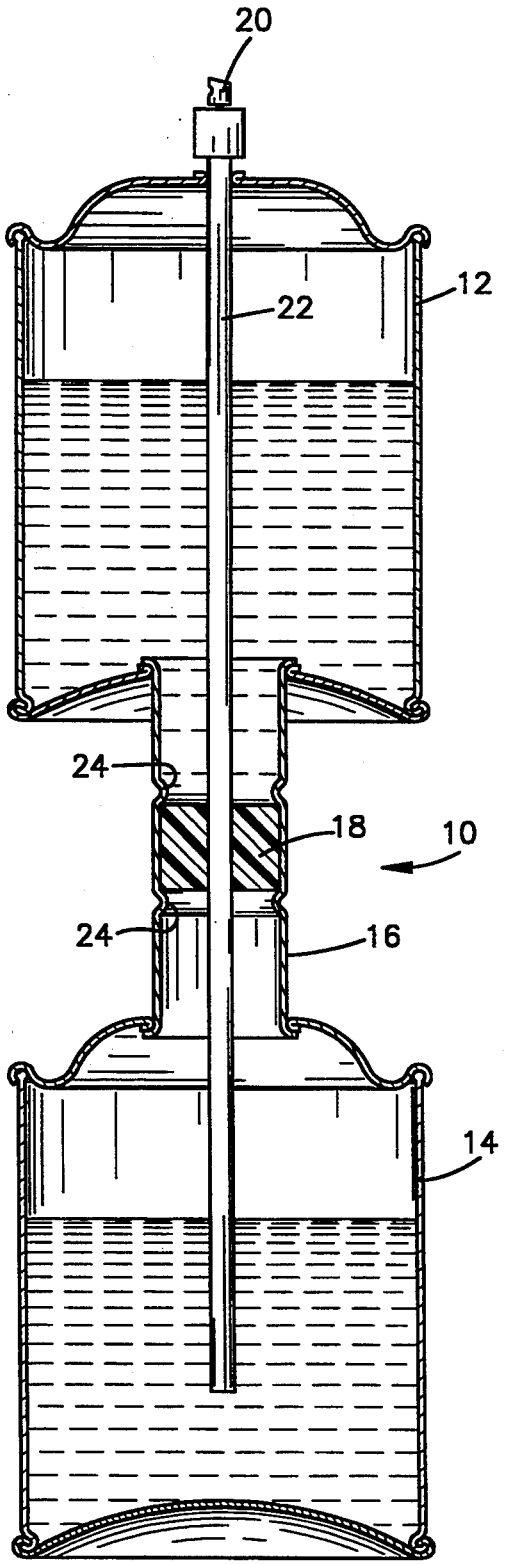
FIG. 1 is a cross-sectional view of an aerosol dispenser according to the present invention in which a fusible plug is disposed in a passageway connecting two containers.

Referring to FIG. 1, an aerosol dispenser according to the present invention is indicated generally by the reference numeral 10. The dispenser 10 is particularly effective for the storage and dispensing of polymerizable paint and the description herein will be with respect to such an application. It is to be understood, however, that the dispenser 10 can be used to dispense any two-part liquid or gaseous composition suitable for spraying.

The dispenser 10 includes a first container 12 and a second container 14 that are joined by a hollow, cylindrical passageway 16. The passageway 16 is blocked by a fusible plug 18, as will be described. The first container 12 includes a spray nozzle 20. A dip tube 22 is connected to the spray nozzle 20 and extends through the interior of the first container 10, through the fusible plug 18, and into the interior of the second container 14. The containers 12, 14, and the passageway 16 are formed from metal using conventional stamping, drawing, and roll-forming techniques. Similarly, the nozzle 20 and the dip tube 22 are formed of plastic materials as is well known in the art. The techniques for joining the containers 10, 20 and for filling the interiors thereof with gas and liquid are conventional and do not need to be described here.

The passageway 16 includes a pair of spaced, inwardly extending circumferential projections 24. The projections 24 are spaced a distance such that the opposed circumferential edges of the plug 18 are engaged by the projections 24. The projections 24 thus provide a mechanical engagement with the plug 18 so as to prevent movement of the plug 18 within the passageway 16.

The plug 18 is formed in situ from a wax, such as a polyethylene glycol wax, having a relatively high melting temperature. Alternatively, the plug 18 is formed in situ from a fusible metal alloy having a relatively low melting temperature. Suitable eutectic alloys are made from base metals such as gallium, indium, tin, bismuth, lead, cadmium, or alloys thereof. The selection of the particular wax or metal alloy to be used for the plug 18 is based on a determination of the maximum storage temperature to which the plug 18 will be exposed, as well as considerations of compatibility with the reactive chemicals in the containers 12, 14. An alloy that contains bismuth is useful for its property of expanding upon solidification. Accordingly, when a plug 18 of such an alloy is formed within the passageway 16, an especially effective seal will be provided. Suitable eutectic alloys can be found in a variety of references, including B. T. K. Barry and C. J. Thivates, *Tin and Its Alloys and Compounds*, pp. 58–61 (1983).

Regardless of the materials selected for the plug 18, the plug 18 should melt at a temperature within the range of about 135°–185° F. It is expected that heat can be applied to the plug 18 so as to cause the melting thereof by disposing the passageway 16 under hot tap water or by directing a stream of heated air onto the passageway 16 by means of a hair dryer. After melting, the plug 18 will resolidify in the form of large drops that will fall to the bottom of the second container 14. By appropriate selection of the materials used for the plug 18, and by appropriate sizing of the diameter of the dip tube 22, occlusion of the dip tube 22 will be prevented. Alternatively, a screen (not shown) can be used to cover the exposed end of the dip tube 22 that is disposed within the container 14.

As will be apparent from an examination of FIG. 1, upon melting the fusible plug 18, the contents of the container 12 will be discharged into the second container 14 and will be intimately mixed with the contents thereof. Typically, the container 12 is filled partially with solvent, catalyst, and propellant. The container 14 is filled partially with solvent, paint base, and possibly propellant as well. If a polymerizable paint is being prepared for spraying, polymerization will start to occur immediately upon discharge of the contents of the container 12 into the container 14. After a short interval during which mixing is completed, the nozzle 20 can be actuated so as to spray paint that is in the process of being polymerized. Because the paint being sprayed is undergoing polymerization while spraying occurs, the finished paint surface will provide a hard, durable, uniform layer upon the evaporation of solvents and propellants. The resultant finish will be far superior to that available through the use of conventional spray cans that employ pre-polymerized, pulverized paint constituents. After spraying has been completed, the dispenser 10 should be discarded because any unsprayed contents will form a solid mass, usually within 24 hours or less.

Figure 2:
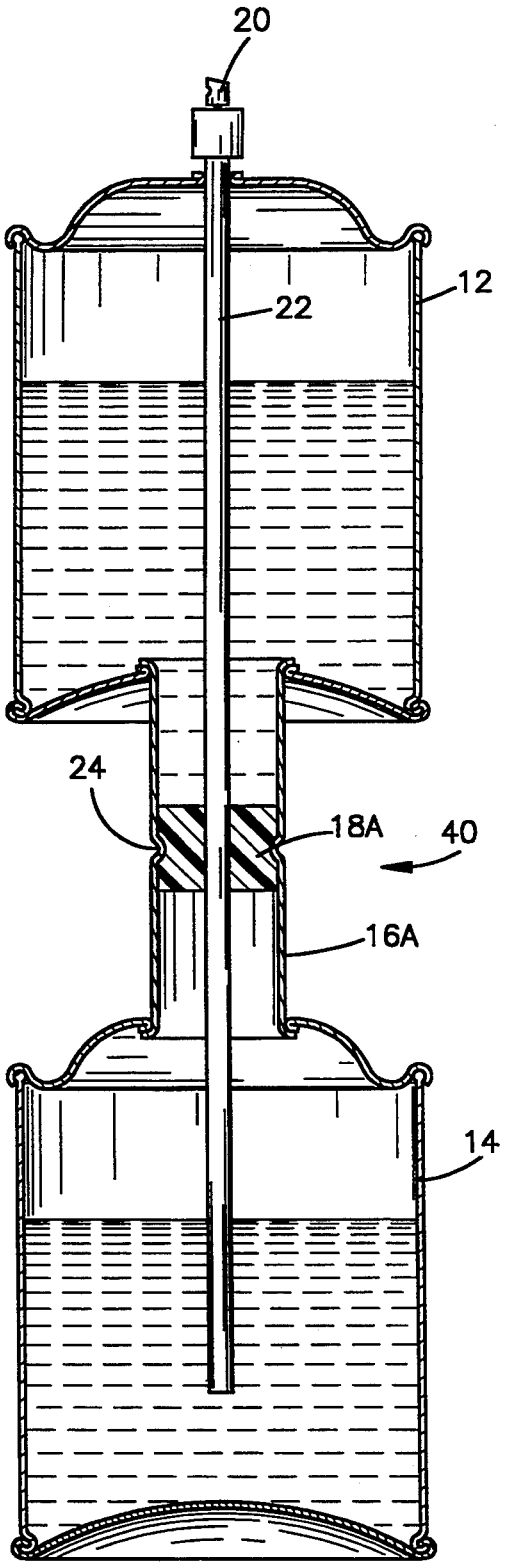
FIG. 2 is a view similar to FIG. 1 showing another technique for disposing a fusible plug in a passageway.

Referring now to FIG. 2, an alternative embodiment of the invention is indicated by the reference numeral 40. An alternate passageway in FIG. 2 is indicated by the reference numeral 16A, while an alternate fusible plug is indicated by the reference numeral 18A. In all other respects, the dispenser 40 shown in FIG. 2 is identical to the dispenser 10 shown in FIG. 1, and like reference numerals will be used to indicate corresponding elements.

The passageway 16A differs from the passageway 16 in that a single radially inwardly extending circumferential projection 24 is employed. The plug 18A is identical with the plug 18, except that the projection 24 is disposed at the midpoint of the plug 18. Due to the engagement between the plug 18A and the projection 24, the plug 18A is held securely in place within the passageway 16.

Figure 3:
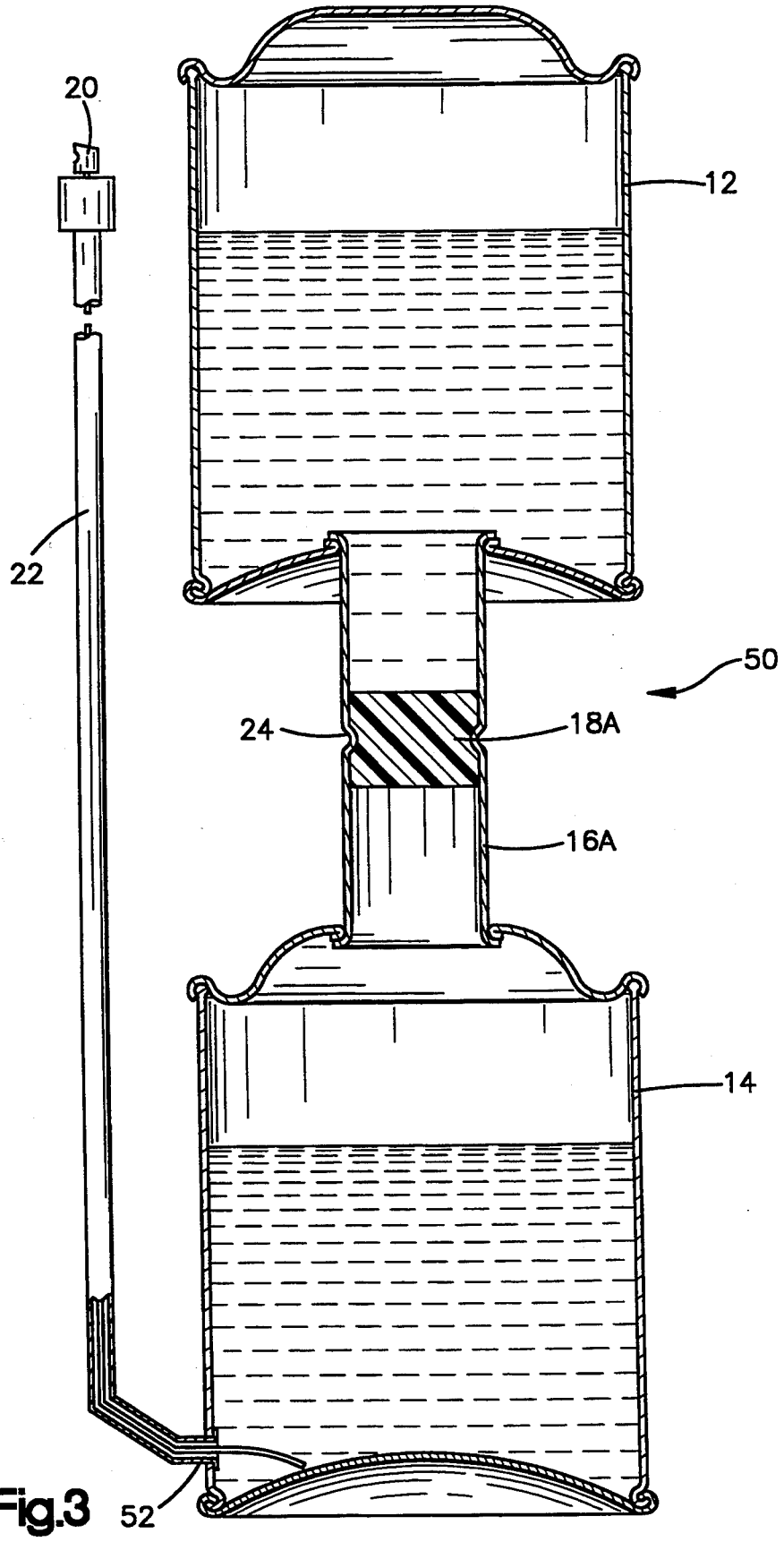
FIG. 3 is a view similar to FIG. 2 showing an alternate form of a spray nozzle.

Referring now to FIG. 3, an additional alternative embodiment of the invention is indicated generally by the reference numeral 50. The embodiment 50 is identical with the embodiment 40, except that the nozzle 20 and the tube 22 are disposed externally of the containers 12, 14. The nozzle 20 is fixed to the first end of the tube 22, while the second end of the tube 22 is connected to the lower portion of the container 14 by means of a ranged connection 52. The ranged connection 52 provides a fluid-tight seal between the tube 22 and the container 14. As will be apparent from an examination of FIG. 3, the length and flexibility of the tube 22 permit the mixed contents of the containers 12, 14 to be dispensed particularly easily, especially in locations that otherwise would be inaccessible to a spray nozzle mounted directly to a container.

Although the invention has been described in its preferred form with a certain degree of particularity, it will be understood that the present disclosure of the preferred embodiment has been made only by way of example and that various changes may be resorted without departing from the true spirit and scope of the invention as hereinafter claimed. It is intended that the patent shall cover, by suitable expression in the appended claims, whatever features of patentable novelty exist in the invention disclosed.

What is claimed is:

1. A pressurized aerosol dispenser, comprising:

a first container in which first constituents are disposed under pressure;

a second container Separate from the first container in which second constituents are disposed;

a passageway integrally connecting the first and second containers, the passageway permitting the first constituents to be discharged into the second container when desired;

a fusible plug disposed in the passageway to prevent discharge of the first constituents into the second container until desired, the fusible plug being melted upon the application of heat thereto; and sprayer means for dispensing the mixed first and second constituents from the second container.

2. The dispenser of claim 1, wherein the fusible plug is formed from metal alloys whose base metal is selected from the group consisting of tin, bismuth, lead, indium, gallium, and cadmium.

3. The dispenser of claim 1, wherein the fusible plug is formed from a polyethylene glycol wax.

4. The dispenser of claim 1, wherein the fusible plug melts at a temperature within the range of about 135°–185° F.

5. The dispenser of claim 1, wherein the passageway includes a projection extending therein, the projection engaging the fusible plug in order to mechanically hold the plug within the passageway.

6. The dispenser of claim 1, wherein the sprayer means is in the form of a spray nozzle included as part of the first container, the sprayer means including a dip tube which extends through the first container and the fusible plug and into the second container.

7. The dispenser of claim 1, wherein the sprayer means is in the form of a spray nozzle and a tube having first and second ends, the spray nozzle being connected to the first end of the tube, the second end of the tube being attached to the second container and being in fluid communication with the interior thereof.

8. A pressurized aerosol dispenser, comprising:

a first container in which first constituents are disposed under pressure;

a second container separate from the first container in which second constituents are disposed;

a passageway integrally connecting the first and second containers, the passageway permitting the first constituents to be discharged into the second container when desired, the passageway including a projection extending therein;

a fusible plug disposed in the passageway to prevent discharge of the first constituents into the second container until desired, the fusible plug being melted at a temperature within the range of about 135°–185° F. upon the application of heat thereto, the fusible plug being formed from a polyethylene glycol wax or a metal alloy whose base metal is selected from the group consisting of tin, bismuth, lead, indium, gallium and cadmium; and sprayer means for dispensing the mixed first and second constituents from the second container.

9. The dispenser of claim 8, wherein the sprayer means is in the form of a spray nozzle included as part of the first container, the sprayer means including a dip tube which extends through the first container and the fusible plug and into the second container.

10. The dispenser of claim 8, wherein the sprayer means is in the form of a spray nozzle and a tube having first and second ends, the spray nozzle being connected to the first end of the tube, the second end of the tube being attached to the second container and being in fluid communication with the interior thereof.

11. A method of storing chemical constituents under pressure, comprising:

providing a first container for receiving first constituents;

providing a second container for receiving second constituents;

providing a passageway and integrally connecting the first and second containers by means of the passageway;

forming a fusible plug in situ within the passageway in order to prevent fluid communication between the first and second containers;

providing a sprayer means for dispensing mixed first and second constituents from the second container, the sprayer means being connected in fluid communication with the second container;

charging the first constituents into the first container under pressure; and charging the second constituents into the second container.

12. The method of claim 11, comprising the further step of applying heat to the fusible plug in an amount sufficient to melt the fusible plug, thereby establishing fluid communication between the first and second containers.

13. The method of claim 12, further comprising the step of activating the sprayer means to dispense mixed first and second constituents from the second container.

* * * * *